United States Patent [19]

Eversdijk

[11] Patent Number: 4,693,346

[45] Date of Patent: Sep. 15, 1987

[54] CASE WITH HOLLOW FRAME

[76] Inventor: Aarnoud W. Eversdijk, 4 Wijkselaan, 2554 GE The Hague, Netherlands

[21] Appl. No.: 758,226

[22] PCT Filed: Nov. 29, 1984

[86] PCT No.: PCT/NL84/00040

§ 371 Date: Jul. 17, 1985

§ 102(e) Date: Jul. 17, 1985

[30] Foreign Application Priority Data

Nov. 29, 1983 [DE] Fed. Rep. of Germany ..... 3343068

[51] Int. Cl.[4] ..... A45C 5/04; A45C 13/10

[52] U.S. Cl. ..... 190/111; 190/112; 190/121; 190/122; 190/127; 190/900; 292/DIG. 42

[58] Field of Search ..... 190/100, 108, 109–112, 190/120, 121, 124, 900, 28, 119, 122, 127; 292/DIG. 42; 312/244; 16/270

[56] References Cited

U.S. PATENT DOCUMENTS

| | | | |
|---|---|---|---|
| 1,454,651 | 5/1923 | Panyity | 190/121 |
| 1,681,269 | 8/1928 | Tueckmantel | 190/110 |
| 2,458,233 | 1/1949 | Wemyss | 190/122 X |
| 3,123,190 | 3/1964 | Lifton | 190/108 |
| 3,135,105 | 6/1964 | Brody | 190/120 X |
| 3,137,374 | 6/1964 | Holtzman | 190/110 |
| 3,205,531 | 9/1965 | Amos | 16/172 |
| 3,263,779 | 8/1966 | Bialer | 190/110 |
| 3,298,479 | 1/1967 | Palmer et al. | 190/127 X |
| 3,477,553 | 11/1969 | Kish | 190/119 |
| 3,807,537 | 4/1974 | O'Reilly | 190/121 |
| 3,912,055 | 10/1975 | Malooly | 190/112 X |
| 3,962,010 | 6/1976 | Riou et al. | 190/122 X |
| 4,008,790 | 2/1977 | Eiteljorg, II | 190/111 X |
| 4,020,930 | 5/1977 | Weber | 190/108 |
| 4,483,427 | 11/1984 | Gerch | 190/900 X |
| 4,503,955 | 3/1985 | Fitzsimmons, Jr. | 190/124 X |
| 4,522,288 | 6/1985 | Wickman et al. | 190/900 |
| 4,540,071 | 9/1985 | Schaub et al. | 190/121 |

FOREIGN PATENT DOCUMENTS

| | | | |
|---|---|---|---|
| 457029 | 12/1974 | Australia . | |
| 1457223 | 10/1969 | Fed. Rep. of Germany . | |
| 1958686 | 6/1971 | Fed. Rep. of Germany | 190/122 |
| 2000776 | 7/1971 | Fed. Rep. of Germany | 190/111 |
| 2213267 | 9/1973 | Fed. Rep. of Germany | 190/111 |
| 3418234 | 11/1984 | Fed. Rep. of Germany | 190/109 |
| 986132 | 3/1951 | France . | |
| 2441358 | 6/1980 | France . | |
| 2506820 | 12/1982 | France . | |
| 961639 | 6/1964 | United Kingdom . | |
| 2104589 | 3/1983 | United Kingdom . | |

*Primary Examiner*—Stephen Marcus
*Assistant Examiner*—Sue A. Weaver
*Attorney, Agent, or Firm*—John P. Snyder

[57] ABSTRACT

In order to make the contents of a case well accessible it has at least three case elements to wit a middle element and at least two side elements arranged one on each side of the former and being pivotable with respect to the middle element.

13 Claims, 19 Drawing Figures

54
29
44
45
X
52
50
48
51
49
57

47
152
45
45
57
56
58
20
46
34
30
31
40
77

37
35
55
33
19
37
36
Y
49
27

FIG.12
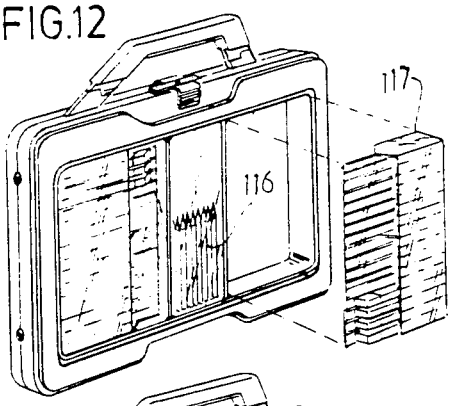
FIG.15
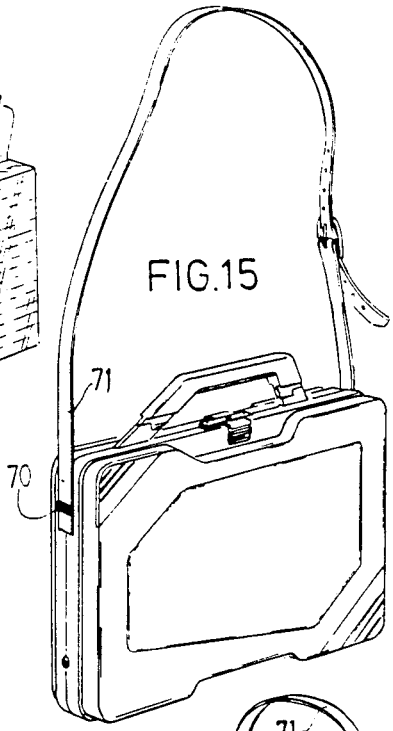
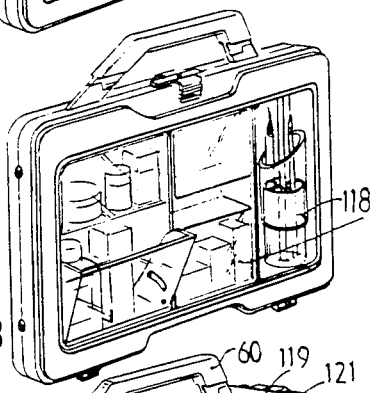
FIG.13
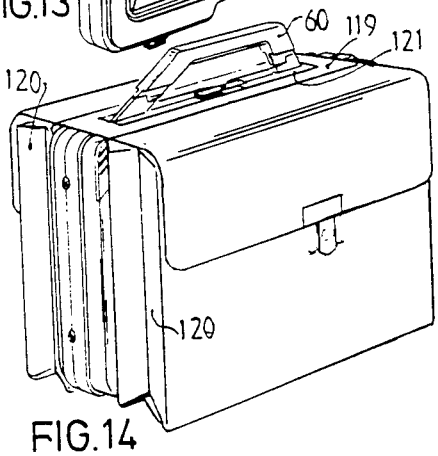
FIG.14
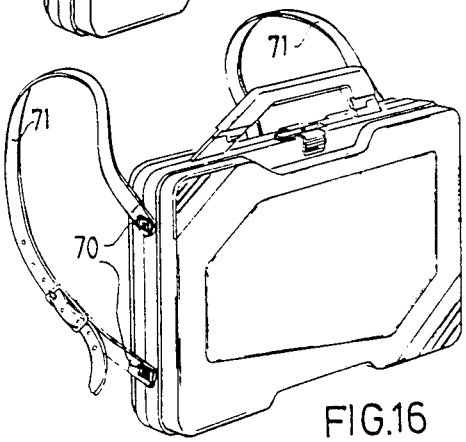
FIG.16

CASE WITH HOLLOW FRAME

The invention relates to a case.

Known cases comprise each a box with a cover. The contents are accessible for an important part only after part of the contents has been removed from the case.

The invention has for its object to improve the accessibility to the contents of a case. The case embodying the invention is characterized by at least three case elements, to wit a middle element and at least two side elements arranged one on each side of the former and being pivotable to said middle element.

Figure 1:
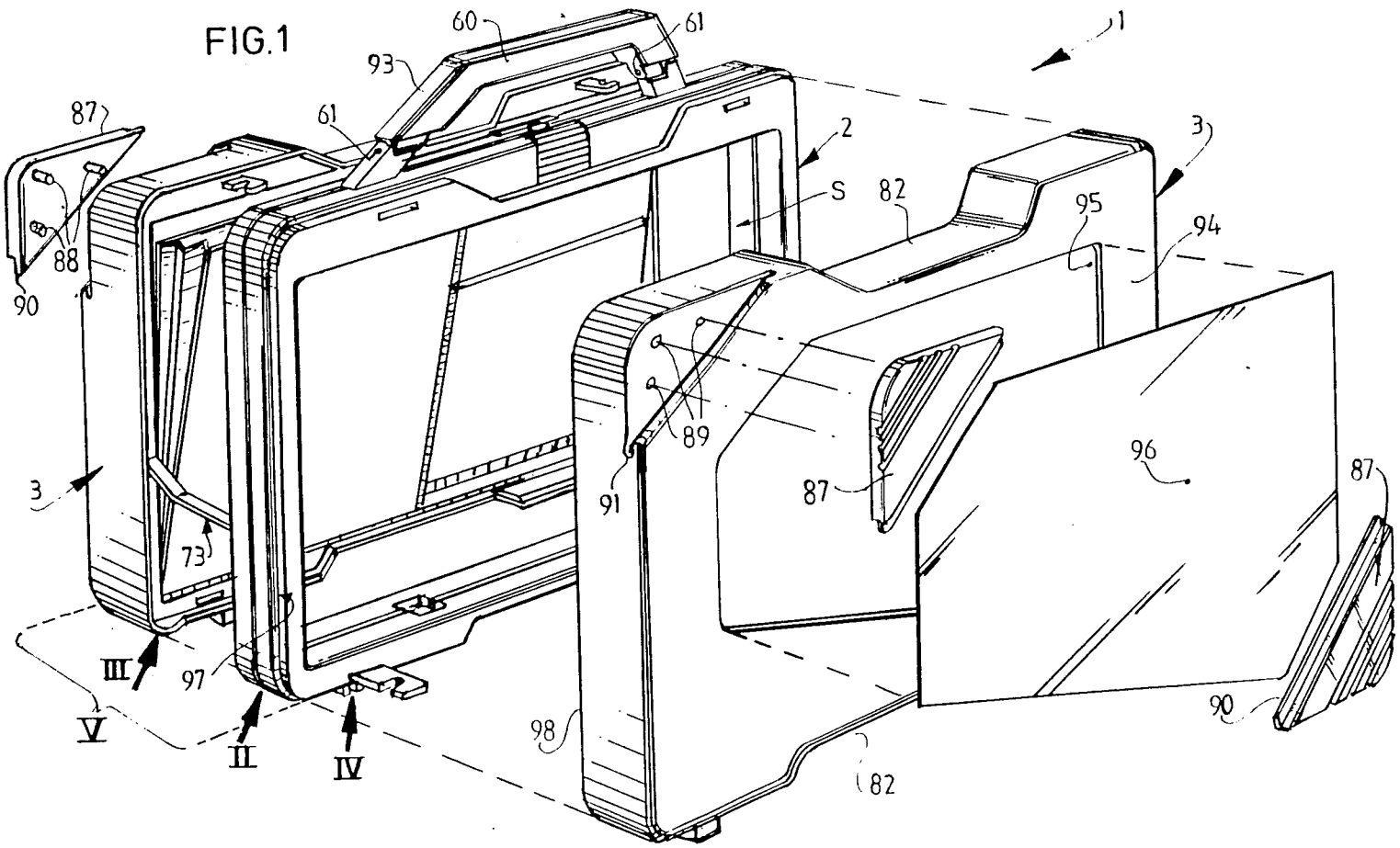
Figure 2:
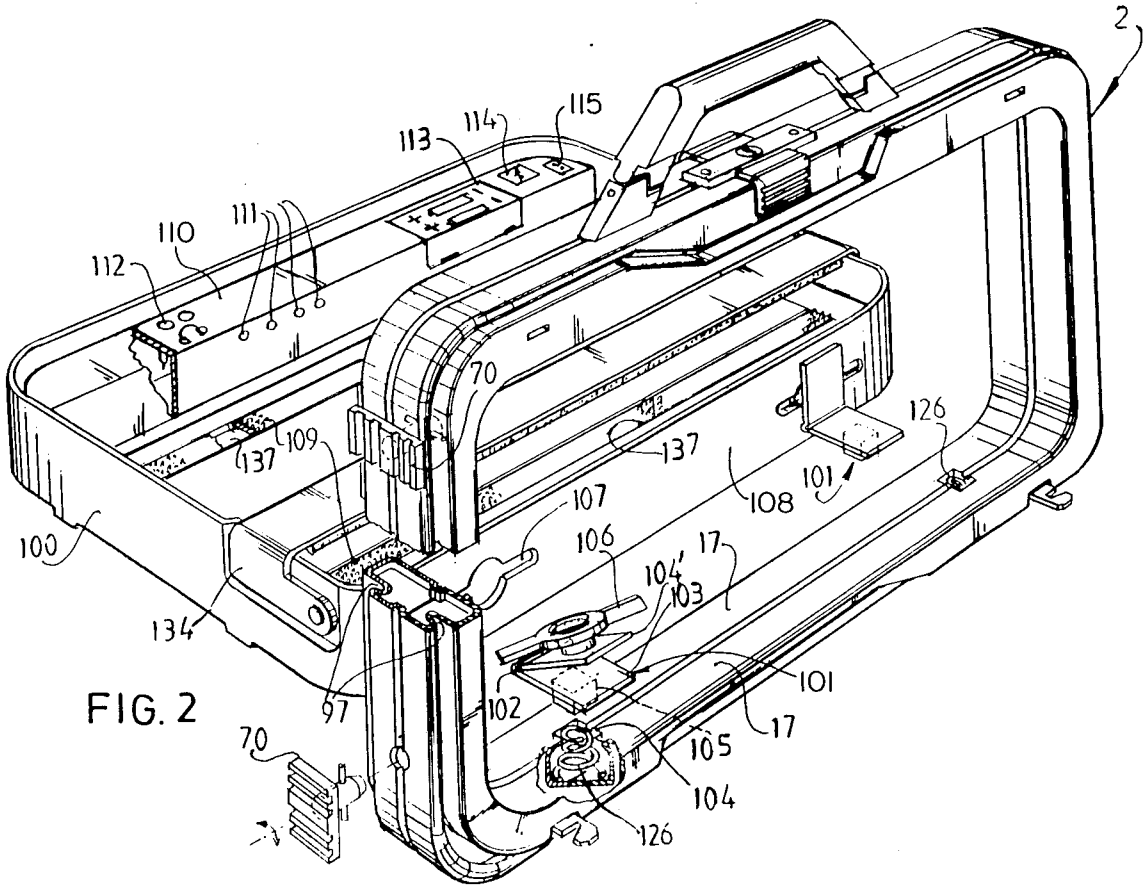
Figure 3:
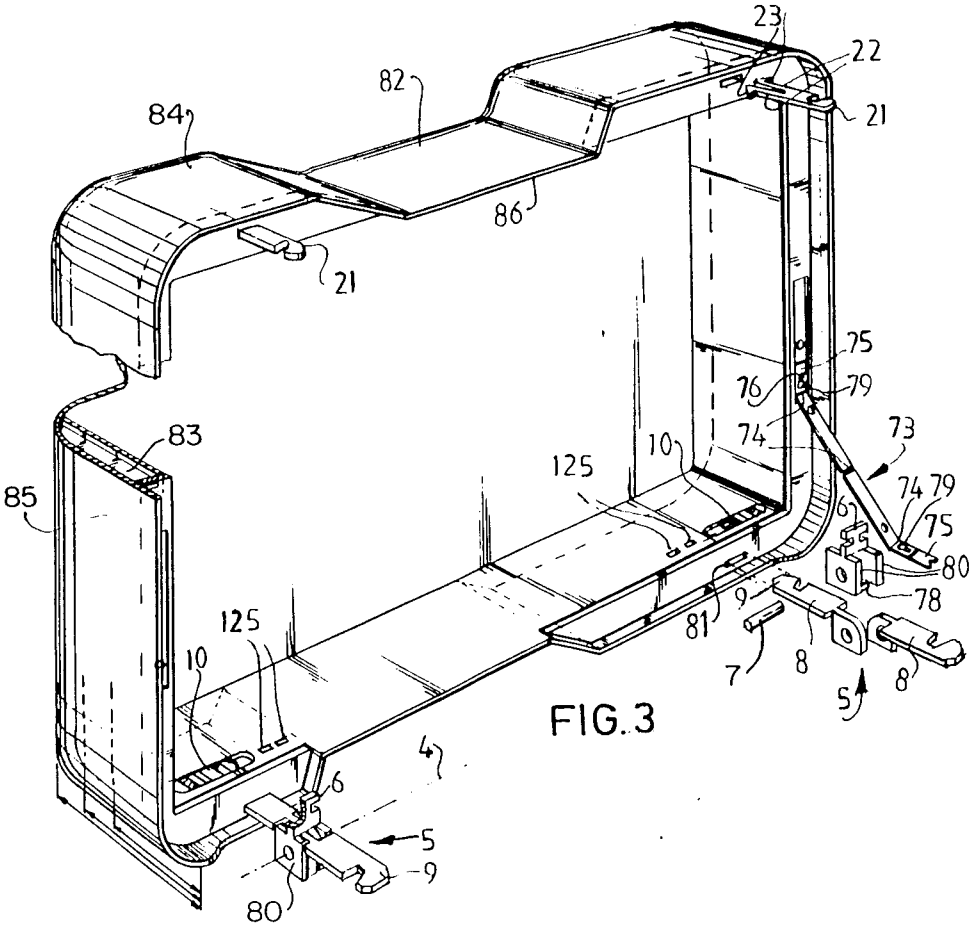
Figure 4:
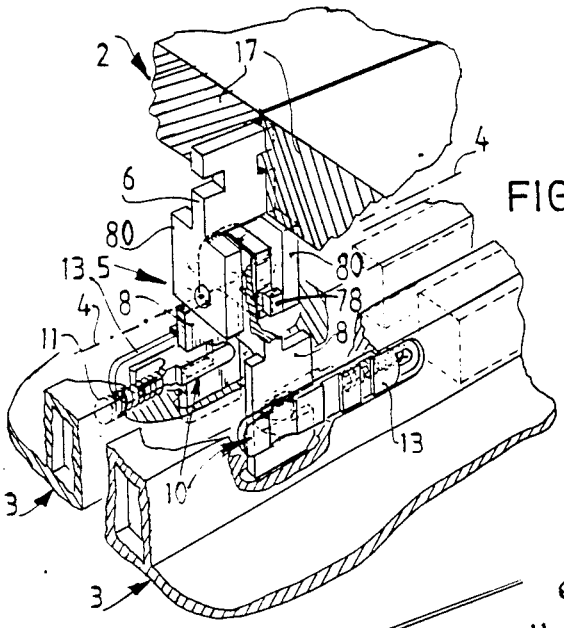
Figure 5:
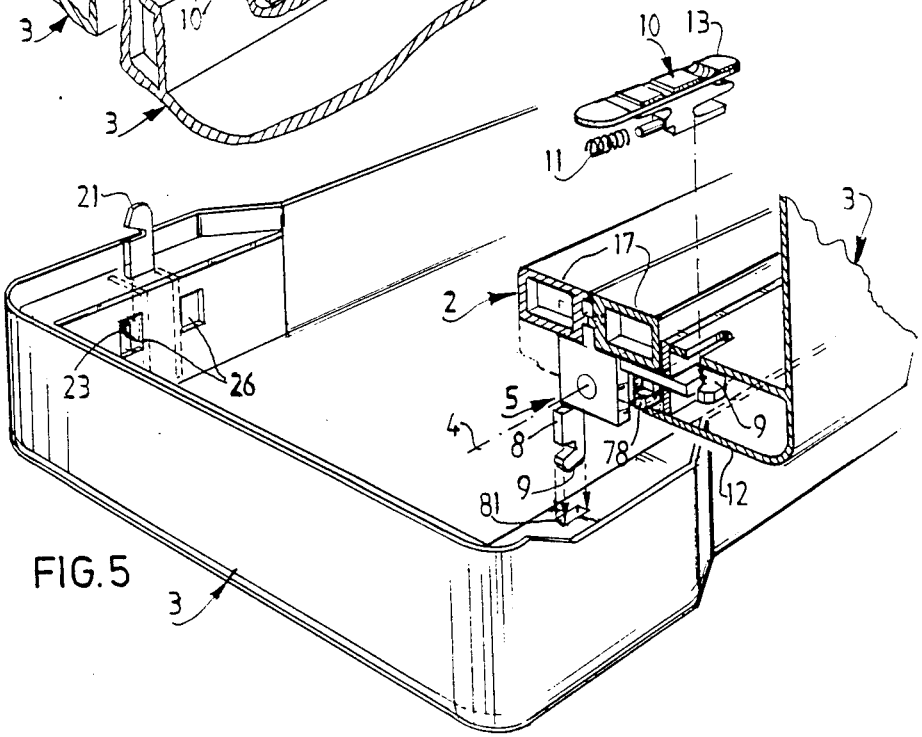
Figure 6:
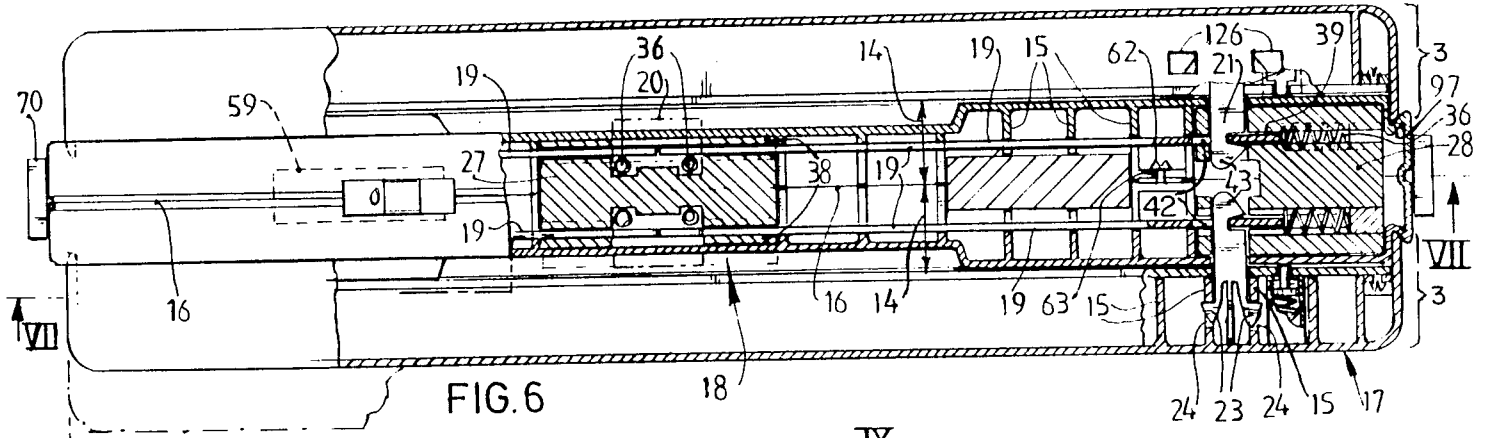
Figure 7:
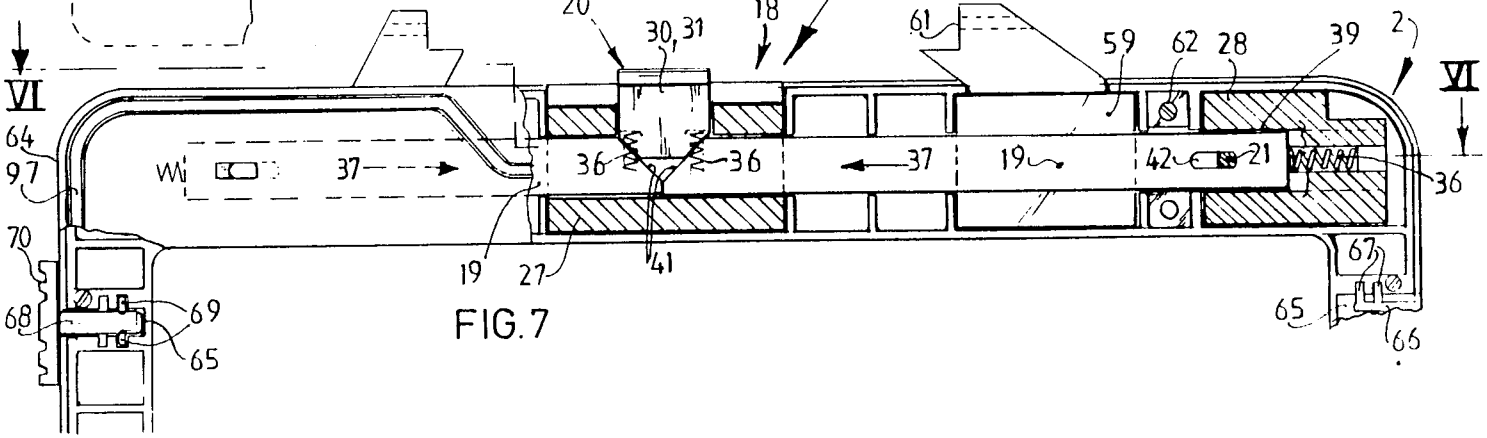
Figure 8:
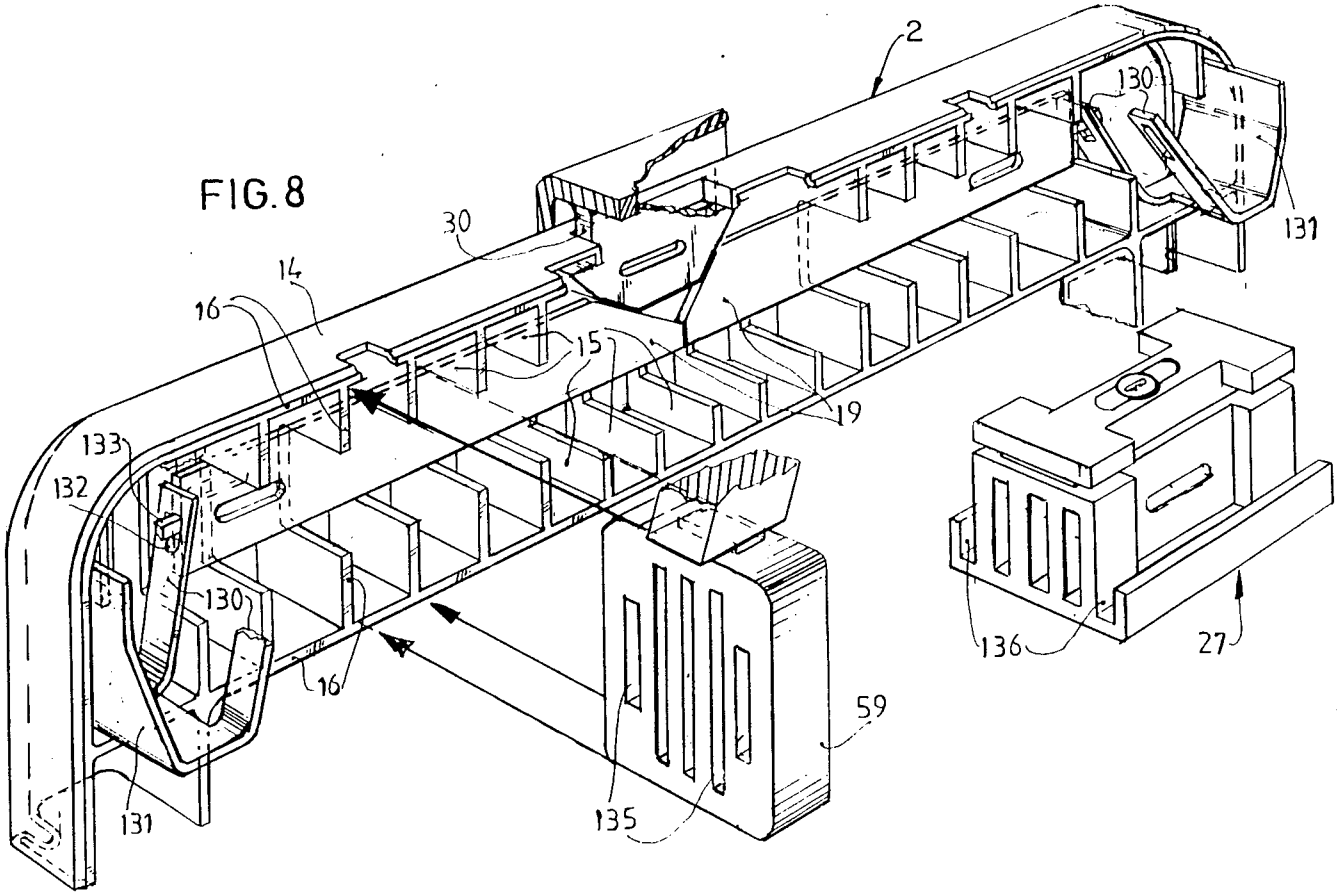
Figures 9, 10, 11:
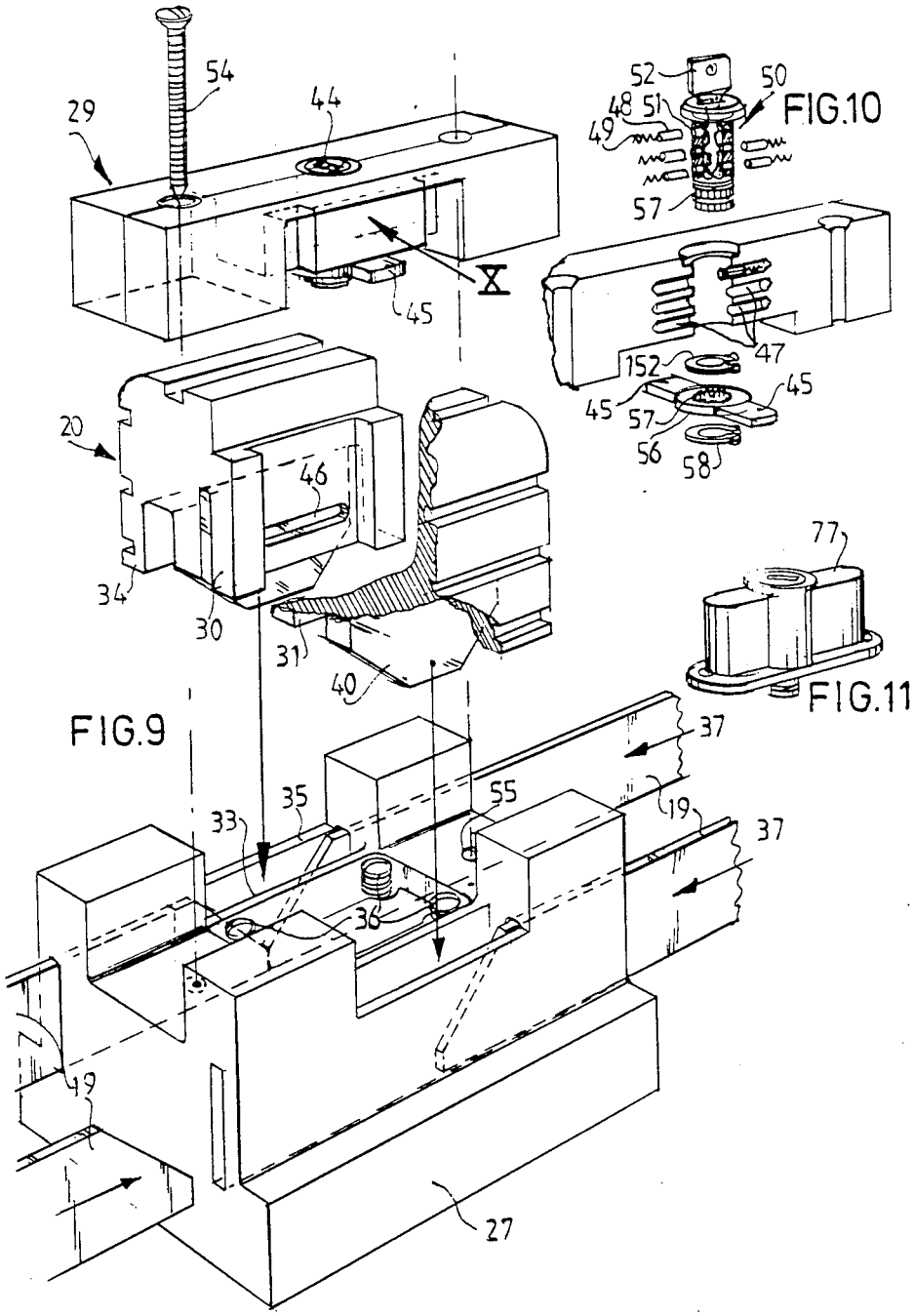
Figure 17:
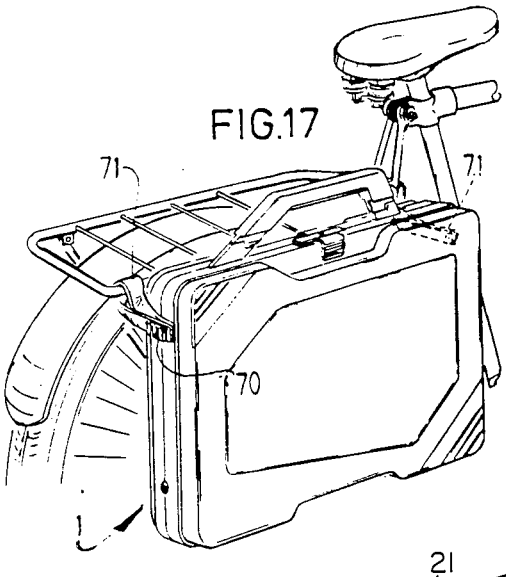
Figure 18:
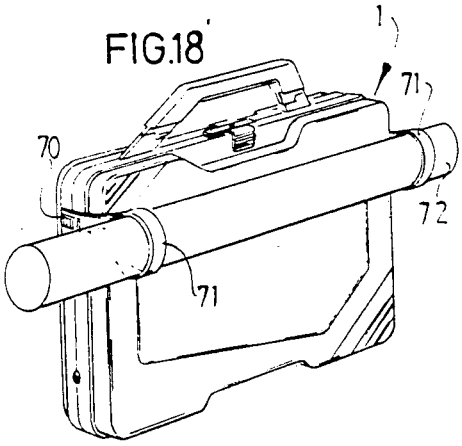
Figure 19:
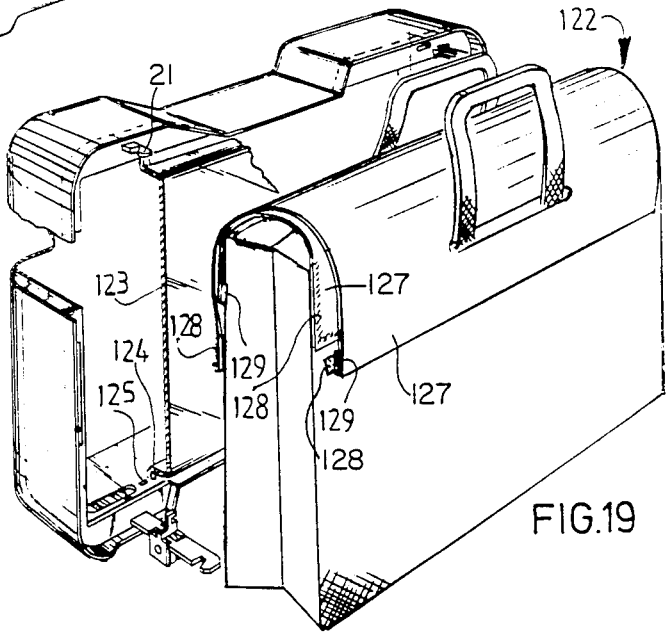

The aforesaid and further features of the invention will be described more fully hereinafter with reference to a drawing in which:

FIG. 1 is a perspective view of a dismounted case embodying the invention,

FIGS. 2 and 3 show on an enlarged scale the fragmentary detail II and III respectively of FIG. 1, FIG. 4 is an enlarged, fragmentary, perspective view of detail IV of FIG. 1 in a different position, FIG. 5 is an exploded, perspective view of detail V of FIG. 1, FIG. 6 is a fragmentary plan view taken on the line VI—VI of FIG. 7 of the case shown in FIG. 1, FIG. 7 a fragmentary elevational view of the case of FIG. 1 taken on the line VII—VII, FIG. 8 is an exploded, perspective view of detail VIII of FIG. 7 relating to a variant of the case of FIG. 1, FIG. 9 an enlarged, exploded, perspective view of detail IX of FIG. 7, FIG. 10 is an exploded, perspective view of detail X of FIG. 9, FIG. 11 is a perspective view of a variant of detail X of FIG. 9, FIGS. 12 and 13 are perspective views of detail II of FIG. 1 with different contents, FIG. 14 is a perspective view of the case of FIG. 1 enlarged by two additional elements, FIGS. 15 to 18 show the case of FIG. 1 with four different kinds of carrying means, and FIG. 19 shows on a reduced scale a perspective view of a variant of FIG. 3.

With reference to FIG. 1, the carrying case of the invention will be seen to include a central section or middle element 2 and the opposite side sections or side elements 3, 3. The central section is formed of two complementary parts 14, 14 which are of generally U-shape in cross section and have reinforcing or rigidifying ribs 15 therein. These two parts or molded frame pieces 14, 14 are joined along their proximal edges 16 to form a substantially hollow, box-like rigid main frame of generally rectangular plan view extending circumferentially of and thereby enclosing an open-sided carrying space S. As illustrated in FIG. 2, a carrier 100 for valuable equipment such as a personal computer may be hingedly mounted within the carrying space S and, as will also be evident from FIG. 2, the central section or main frame may be completely separated from the side elements 3,3. The separate side carrying sections 3, 3 are of dished, molded form as will be evident from FIGS. 1 and 3 in particular. The peripheral walls of these sections 3, 3 are also of hollow, generally box-like form to lend rigidity thereto. The hollow, box-like forms of the peripheral walls of the sections 3, 3 and of the main frame comprising the central section 2 are used, interiorally thereof, to mount various entities which serve to connect the several sections together for pivotal movements therebetween and for separation and/or locking or latching therebetween, as will be described later. These various entities are carried or mounted within the box-like constructions and, in certain cases, slidable or movably therewithin and in cooperation with reinforcing or rigidifying ribs within the box-like structures.

The case 1 embodying the invention mainly comprises three releasable elements relatively pivotable about a common axis 4, to wit a middle element 2 and two side element 3 arranged one on each side of the former. The case 1 has two common hinges 5 in line with the common axis 4 (FIGS. 3, 4 and 5), each having an anchor-shaped hinge vane 6 embedded in the middle element 2. The hinge vane 6 has two cheeks 80, in which a pin 7 is journalled. About the pin 7 can turn two hinge vanes 8, each having a hook-shaped engaging element 9, which co-operates in a locking manner with a lock bolt 10 arranged in a side element 3 and being displeaceable against the action of a spring 11 out of a locked position into an unlocked position. The lock bolts 10 each have a control-member 13 on the inner side of the wall 12 of a side element 3 and are guided in the wall 12 in the direction of the axis 4. Owing to the detachability a case 1 can be composed of various case elements 2 and 3 so that ample choice of combinations of colors, depths and lining and/or internal equipment is offered. The middle element 2 mainly comprises two frame-shaped moulded pieces 14 of synthetic resin, each having a substantially U-shaped profile (see FIGS. 6 and 7) and being provided with stiffening ridges 15. The proximal edges 16 of the moulded pieces 14 are joined, for example, by heat welding so that a closed, rugged, frame-shaped box 17 is obtained. In this box 17 are arranged, apart from the aforesaid hinge vanes 8, locking means 18. The locking means 18 comprise two pairs of lock bolts 19, which are actuated pairwise centrally and simultaneously by a control-element 20 and which co-operate with two relatively spaced engaging elements 21 on one and the same side element 3, each engaging element being formed by a hook having two limbs 22 (see FIG. 3), whose feet 23 snap into cavities 24 of ridges 15 owing to the spreading spring action of the limbs 22 (FIG. 6). The limbs 22 can be pressed towards one another against spring force for dismounting with the aid of a tool inserted into side holes 26 on each side of each engaging element 21 (FIG. 5).

The locking means 18 comprise a central locking block 27 and two locking blocks 28 arranged at a distance on both sides of the former. The locking block 27 comprises a lock housing 29 and two control-elements 20, which can be moved vertically downwards against compression springs 36 for unlocking the lock bolt 19 (FIG. 9). For the vertical movement the control-element 20 has vertical guide pieces 30 and 31 sliding up and down on both sides of a vertical partition 33, whilst an outer column 34 moves up and down along the outer side of a partition 35 of the locking block 27. The lock bolts 19 are formed by steel bars which are urged into their locking position in the direction indicated by arrows 37 by means of compression springs 36 (FIGS. 6 and 7) arranged in locking blocks 28. The locking bolts are guided inside the box 17 in their direction of length, i.e. in a horizontal direction along the ridges 15 and in adjoining, fitting slots 38 and 39 of the locking block 27 and a locking block 28 respectively. Each control-element 20 has a wedge 40, which simultaneously co-operates with wedge ends 41 (FIG. 7) in order to urge the lock bolts 19 away from one another opposite the direction of the arrow 37 during a downward movement. Then the hook-shaped engaging elements 21 can each pass through a slot 42 in their lock bolt 19 for unlocking. For locking the wedge-shaped bolt head 43 of each engaging element 21 can urge the lock bolt 19 concerned by a wedge effect against spring action away when the side element 3 concerned is turned towards the middle element 2.

The case 1 can be opened, that is to say, a depression of the control-elements 20 is only possible when a lock 44 is unlocked by a key 52, that is to say when two wings 45 of the lock 44 located in the locked state in two horizontal slots 46 of two control-elements 20 are turned out of them. A bipartite lock housing 29 of sythetic resin has internal bores 47 for receiving lock pins 48 with compression springs 49, whilst a lock cylinder 50 having key pins 51 matching a key 52 is fastened with the aid of a guard ring 152. The lock housing 29 is fastened in the locking block 27 by means of screws 54 screwed into tapped holes 55 in the locking block 27.

The wings 45 are fastened to a wing ring 56, which is fastened by a toothing 57 and a guard ring 58 to the lock cylinder 50. As an alternative a lock housing 77 of known type shown in FIG. 11 may be fastened to the locking block 27.

On both sides of the locking block 27 a bearing block 59 is arranged in the frame-shaped box 17 between ridges 15 and, for example, glued or heat-welded thereto. A handle 60 is pivotally fastened by means of pivotal pins 61 to the bearing blocks 59. Said locking means 18 and bearing blocks 59 are arranged between the moulded between the two moulded pieces 14, which are provisionally held together during mounting by means of a plurality of press-buttons 62 formed on one moulded piece 14 and snapping into an opposite recess 63 of the other moulded pieces 14. Afterwards the moulded pieces can be united by heat welding to form such a strong box 17 that one can sit down on it. For this purpose two supporting elements 99 with bores 65 are provided on the short sides 64, each element having two longitudinal grooves 66 and two annular grooves 67, into which a pin 68 with two transverse pins 69 of a bottom support 70 can be hooked.

These bottom supports 70 can serve in addition as fastening hooks for carrying straps 71 (see FIGS. 15 to 18) so that the case 1 may be used as a shoulder case, as a back caes, as a bicycle case or as a drawing case with a drawing box 72 fastened thereto.

Owing to the common pivotal axis 4 the middle element 2 can be swung on one side element 3 as well as on the other, then the case 1 is open, whilst it can be put in a vertical position without the need for moving the two side elements 3. Whilst the side elements 3 are in lying positions, the middle element 2 can be fixed in the vertical position with the aid of struts 73 of synthetic resin, each having three hinges of synthetic resin 74, the ends 75 of which are fastened by means of button holes 79 and buttons 76.

In order to facilitate the interconnection between the side elements 3 and the middle element 2 each hinge vane 8 is provided with a stop cam 78, which, in the furthest opened state of the hinge 5, strikes a cheek 80 (FIG. 5) in a vertical position in order to allow lowering of the middle element 2 with the two vanes 8 in a vertical direction into the corresponding recesses 81 of a side element 3.

The case 1 has a beautiful appearance and a specific external design, in particular owing to recesses 82 in the long sides 84 of the side elements 3. These recesses 82 do not or only hardly take space in the interior of the case because the rims of the long side 84 must, in any case, have hinge vanes 8 with lock bolts 10 and engaging elements 21 and in particular stiffening ridges 83. The short side 85 and the long side 84 of the side elements 3 are double-walled with interposed ribs 83 with the exception of the areas of the recesses 82. In this way a strong, lightweight construction is obtained. The trapezoidal recess 82 impart to the side elements 3 a great resistance to deformation. The synthetic resin tube shell 86 is very rigid also owing to the trapezoidal recesses 82.

The case 1 is furhermore embellished by ornamental corner pieces 87, which are each lodged by three pins 88 in matching holes 89 of opposite corners 92 and which are engaged by their inclined longitudinal edge 90 in a groove 91 of a corner 92. A limb 93 of the asymmetrical handle 60 extends parallel and substantially in line with the inclined longitudinal edge 90. The outer side 94 of each side element 3 has an asymmetrical stiffening cavity 95 in which an identity carrier 96 in the form of a plate or an adhesive sheet, for example, of a different color may be glued.

On the other circumference the box 17 has on both sides a groove 97 for receiving a rim 98 of a side element 3 to serve as a water arrester (FIG. 1). On the underside this precaution is not taken because it is not necessary.

In the middle element 2 is pivotally fastened a holder 100 by means of fastening means 101. The fastening means 101 are formed by a synthetic resin hinge 102, a vane 103 of which has a support 105 vertically guided in a recess 104 of the box 17 and being loaded by a compression spring 126, whereas the other vane 104' is provided with a portable knob 106, which is passed through a hole 107 of a rim 108 of the holder 100.

The holder 100 has a size particularly suitable for accommodating a small computer which is held in place by means of a pivotable bracket 134 and tape fastener 109 arranged in cavities 137. The holder 100 has futhermore a casing 110 for electrical precautions such as connections 111 for a computer or other apparatus, a connector 112 for a headphone, a battery holder 113, a voltage meter 114 and a connector 115 for the mains current.

The holder 100 may also be designed for accommodating drawing material 116 or cassettes 117 (FIG. 12) or cosmetic means 118 (FIG. 13).

As shown in FIG. 14 the case 1 may be enlarged by two additional elements 120, which are interconnected by means of a suspension member 119 having a recess 121 for the handle 60.

As shown in FIG. 19 a side element 3 can receive a bag 122, for example, for wet textile, the bag 122 being screened by a cover plate 123 of synthetic resin, which is in resilient contact by bags 124 with recesses 125 of the side element 3. The bag 122 has fastened to it two overlapping flaps 127 with seal seams 128 that can be closed by tape fastener 129.

In the alternative embodiment of FIG. 8 the lock bolts 19 are embedded to a greater extent in the moulded pieces 14. The ridges 15 serve more strongly as guides for the lock bolts 19, which are each urged by means of a strip 130 of a leaf spring 131 into the locked position. The strips 130 are in engagement with an extension 133 of the lock bolts 19 by means of eyelets 132.

Bearing blocks 59 with recesses 135 for the lock bolts 19 are arranged between ridges 15 as well as a locking block 27 having guide grooves 136 for the lock bolts 19.

I claim:

1. A carrying case which comprises the combination of a middle carrying element and a pair of side carrying elements separate from and disposed on either side of the middle carrying element, said middle carrying element comprising a pair of complementary members molded of synthetic resin and each of generally U-shaped cross section, said members being united with each other in opposed relation such that their U-shaped cross sections cooperate to define a substantially hollow, box-like rigid frame of generally rectangular cross-section and of open, generally rectangular plan view extending circumferentially of and thereby circumscribing an open carrying space bounded on opposite sides thereof by said side carrying elements.

2. A carrying case as defined in claim 1 including means for pivoting the carrying elements relative to each other about a common pivot axis.

3. A carrying case as defined in claim 1 including a holder disposed within said open carrying space defined by the box-like rigid frame.

4. A carrying case as defined in claim 3 including pivot means pivotally mounting said holder within said carrying space for swinging movement outwardly of an open side thereof.

5. A carrying case as defined in claim 4 including fastening means for releasably mounting said pivot means to the peripheral wall construction of the box-like rigid frame and within the open carrying space defined thereby.

6. A carrying case which comprises the combination of a central carrying section and a pair of side carrying sections separate from and disposed on either side of the central carrying section, said central carrying section comprising a pair of complementary members each of generally U-shaped cross section and joined to each other in opposed relation such that their U-shaped cross sections cooperate to define a substantially hollow, box-like rigid main frame of generally rectangular cross-section and of open, generally rectangular plan view extending circumferentially of and thereby circumscribing an open carrying space bounded on opposite sides thereof by said side carrying sections, and means pivotally connecting said side carrying sections to opposite sides of said main frame for movements between closed positions which close the opposite sides of said open carrying space to access and open positions exposing said open carrying space to access through the respective sides thereof.

7. A carrying case which comprises the combination of a central carrying section and a pair of side carrying sections separate from and disposed on either side of the central carrying section, said central carrying section being in the form of a substantially hollow, box-like rigid frame of generally rectangular cross-section and of open, generally rectangular plan view extending circumferentially of and thereby circumscribing an open carrying space bounded on opposite sides thereof by said side carrying sections, said box-like rigid frame having transverse rigidifying ribs therewithin, means pivotally connecting said side carrying sections to opposite sides of said box-like rigid frame for movements between closed positions which close the opposite sides of said open carrying space to access and open positions exposing said open carrying space to access through the respective sides thereof, at least one locking element projecting from each side carrying section and said box-like rigid frame having openings in the opposite sides thereof for receiving said locking elements, and locking bar means slidably carried by said ribs within the box-like rigid frame for releasable engagement with said locking elements.

8. A carrying case which comprises a plurality of separate sections each having a peripheral wall construction of hollow, generally box-like cross sectional form, one of said sections being normally disposed between a pair of other sections, means mounted within and projecting from a peripheral wall portion of the one section for pivoting said sections together and including members projecting into peripheral wall portions of the pair of sections and connecting such pair of sections to the one section.

9. A carrying case as defined in claim 8 including reinforcing and rigidifying ribs within the peripheral wall constructions.

10. A carrying case as defined in claim 8 including latching means mounted within and projecting from peripheral wall portions of the pair of sections, the peripheral wall construction of the one section having openings therein through which said latching means may be received, and means slidably mounted within the peripheral wall construction of the one section and guided by ribs therein for latching and releasing said latching means.

11. A carrying case which comprises the combination of a central section and a pair of side sections separate from and disposed on either side of the central section, said central section comprising a pair of complementary members of molded material, each of generally U-shaped cross section and joined to each other in opposed relation such that their U-shaped cross sections cooperate to define a substantially hollow, box-like rigid main frame of generally rectangular cross-section and of open, generally rectangular plan view extending circumferentially of and thereby circumscribing an open carrying space bounded on opposite sides thereof by said side sections, said side sections being of molded material and of dished form to define respective carrying spaces each open only at that side thereof facing the open carrying space defined by the central section and overlapping peripheral wall portions of the central section, and means carried by said central section and projecting downwardly thereof for defining a pivot axis and including connecting means pivotally mounted on the pivot axis and projecting from said pivot axis for pivotally connecting said side sections to said main frame for movements between closed positions which close the opposite sides of said carrying space to access and open positions exposing respective sides of said carrying space to access.

12. A carrying case as defined in claim 11 including releasable means for connecting said connecting means withing the respective side sections so that the sections are completely separable.

13. A carrying case as defined in claim 12 including latching elements projecting from the side sections into the frame and means slidably carried within the frame for releasably engaging the latching elements.

* * * * *